US005337482A

United States Patent [19]

Schmidt

[11] Patent Number: 5,337,482

[45] Date of Patent: Aug. 16, 1994

[54] SAFETY BLADE FOR UTILITY KNIFE

[75] Inventor: G. Gerry Schmidt, Newport Beach, Calif.

[73] Assignee: Pacific Handy Cutter, Inc., Costa Mesa, Calif.

[21] Appl. No.: 79,703

[22] Filed: Jun. 18, 1993

Related U.S. Application Data

[63] Continuation of Ser. No. 926,597, Aug. 6, 1992, abandoned.

[51] Int. Cl.[5] ..... B26B 9/02

[52] U.S. Cl. ..... 30/162; 30/351; 30/357

[58] Field of Search ..... 30/351, 346, 357, 346.5, 30/346.55, 335, 162

[56] References Cited

U.S. PATENT DOCUMENTS

| | | | |
|---|---|---|---|
| 1,820,407 | 8/1931 | Thompson | 30/346.55 |
| 1,881,334 | 10/1932 | Treiber | 30/346.55 |
| 1,995,232 | 3/1935 | Tipery | 30/346.61 |
| 2,679,094 | 5/1954 | Nolan | 30/346.61 |
| 2,679,100 | 5/1954 | Ehler | 30/351 |
| 2,788,574 | 4/1957 | Marcmann | 30/351 |
| 3,488,843 | 1/1970 | Tims, Jr. | 30/162 |
| 4,620,368 | 11/1986 | Bowman | 30/335 |

OTHER PUBLICATIONS

"Rounded-Tip Utility Blades" by Hyde, 1991.

*Primary Examiner*—Richard K. Seidel
*Assistant Examiner*—Hwei-Siu Payer
*Attorney, Agent, or Firm*—Poms, Smith, Lande & Rose

[57] ABSTRACT

A blade for a utility knife is provided which has a trapezoidal shape with a cutting edge and a pair of side edges which converge towards a blunt back edge. A safety edge joins each of the side edges with the cutting edges. The safety edges intersect with the cutting edge at an obtuse angle and provide substantially blunt surfaces. Safety corners are formed at intersections of the safety edges and the side edges. The safety corners are disposed at the outermost distal ends of the blade relative to the cutting edge. Cutting corners are formed at the intersections of the safety edges and the cutting edge. The cutting corners are disposed inwardly along the cutting edge relative the safety corners. This way, inadvertent contact between an operator and a safety edge would not be likely to cause injury since the safety corners would be contacted first.

5 Claims, 1 Drawing Sheet

SAFETY BLADE FOR UTILITY KNIFE

This is a continuation of copending application(s) Ser. No. 07/926,597 filed on Aug. 6, 1992, now abandoned.

BACKGROUND OF THE INVENTION

The present invention relates to utility knives which utilize disposable blades, and more particularly, to a safety blade for a utility knife having edges which reduce the risk of inadvertent injury to the user.

DESCRIPTION OF RELATED ART

Utility knives having disposable blades are well known in the art. These knives have many industrial as well as home uses, such as for opening boxes, cutting cord, or carving wall board or wood. The typical utility knife has a plastic or metal handle with a retractable blade. When not in use, the blade is retracted into the body of the handle so that the knife can be safely stored or handled. When in use, the blade can extend outwardly from the handle, exposing the cutting edge of the blade.

Utility knife blades come in a variety of shapes, depending upon the intended use. A typical form of blade has a generally trapezoidal shape, with a wide cutting edge. The two side edges converge from the outer ends of the blade toward a narrower back edge. The side edges and the back edge are blunted. The blade may additionally have an aperture pattern through a center portion of the blade which enables the blade to be secured within the handle. The trapezodially shape blades are popular since they have pointed cutting corners formed at the intersections between the side edges and the cutting edge. These cutting corners enable a user to puncture through a material which is desired to be cut, such as sealing tape closing a box. Once the object has been punctured, the user can slice open the material by dragging the knife laterally along the surface of the material and allowing the cutting edge to pull through the material.

Although blades having cutting corners are preferred for the reasons described above, the cutting corner frequently causes injury to the user. The blade can cause inadvertent injury when being used, such as by the cutting corner puncturing the skin of the operator. Additional care must be taken when loading a fresh blade into the holder, in order to avoid contact with the cutting corner. The user must hold the blade by contacting only the broad surfaces of the blade, such as between the thumb and forefinger.

Instead of using the trapezodially shaped blade, a user could select a rectangular blade so as to minimize this risk of injury. The rectangular shape blade has side edges which intersect with a cutting edge at a 90 degree angle. This type of blade can be carried by holding the side edges between the thumb and forefinger, and are thus much more safe. However, rectangular shaped blades do not have a pointed cutting corner, and are less useful in applications requiring puncturing.

Thus, it would be desirable to provide a blade for a utility knife having a cutting corner as in a trapezodially shaped blade with the safety aspects of a rectangular shaped blade.

SUMMARY OF THE INVENTION

Accordingly, a principal object of the present invention is to provide a blade for a utility knife having blunt side edges to prevent injury, but while still having a cutting corner for puncturing usages.

To achieve the foregoing objects, and in accordance with the purpose of the invention, a utility blade is provided which has a generally trapezoidal shape with a cutting edge and a pair of side edges which converge toward a blunt back edge. A safety edge joins each of the side edges with the cutting edge. The safety edges intersect with the cutting edge at an obtuse angle and provides substantially blunt surfaces. Inadvertent contact between an operator and a safety edge would not be likely to cause injury.

More particularly, the utility blade comprises safety corners formed at intersections of the safety edges and the side edges. The safety corners are disposed at the outermost distal ends of the blade relative the cutting edge. In addition, the blade comprises cutting corners formed at intersections of the safety edges and the cutting edge. The cutting corners are disposed inwardly along the cutting edge relative the safety corners.

A more complete understanding of the safety blade for use in a utility knife of the present invention will be afforded to those skilled in the art as well as a realization of additional advantages and objects thereof, by consideration of the following Detailed Description of the Preferred Embodiment. Reference will be made to the appended sheets of drawings which will be first described briefly.

DESCRIPTION OF A PREFERRED EXEMPLARY EMBODIMENT

Figure 1:
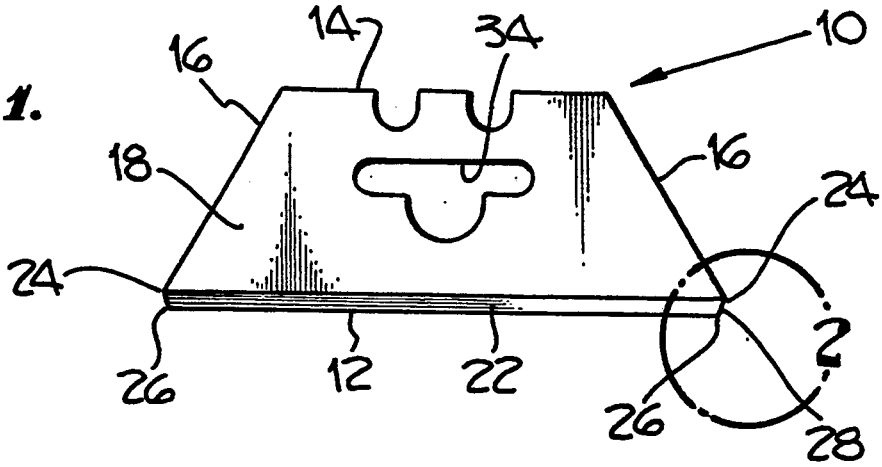
FIG. 1 is a front view of a safety blade for a utility knife of the present invention.
Figure 4:
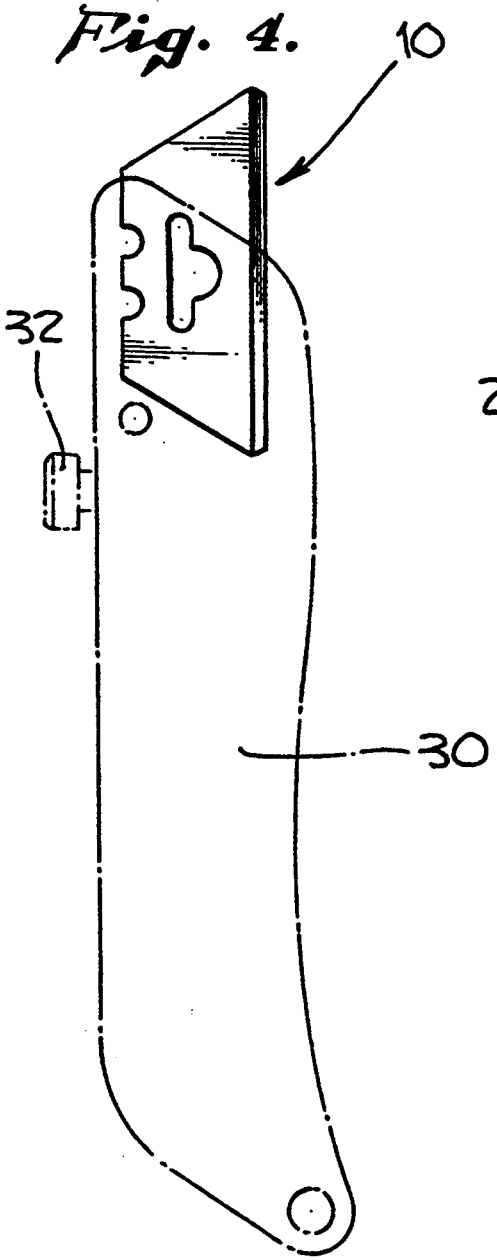
FIG. 4 shows the safety blade of the present invention used in conjunction with a utility knife handle.

Referring first to FIG. 1, there is shown a safety blade 10 of the present invention. The blade is typically formed from a high strength material such as steel. The blades can be formed by known machining techniques, such as stamping from a sheet of material.

The blade 10 has a generally trapezoidal shape, including a cutting edge 12, a rear edge 14 and a pair of converging side edges 16 which extend between the cutting edge and the rear edge. The cutting edge 12 is formed by machining bevelled surfaces 22 onto the broad blade surface 18 adjacent to the edge 12. Since the material of the blade is very thin, approximately .02 inches, the cutting edge can be very sharp. In contrast, the side edges 16 and the rear edge 14 are blunt.

Figure 2:
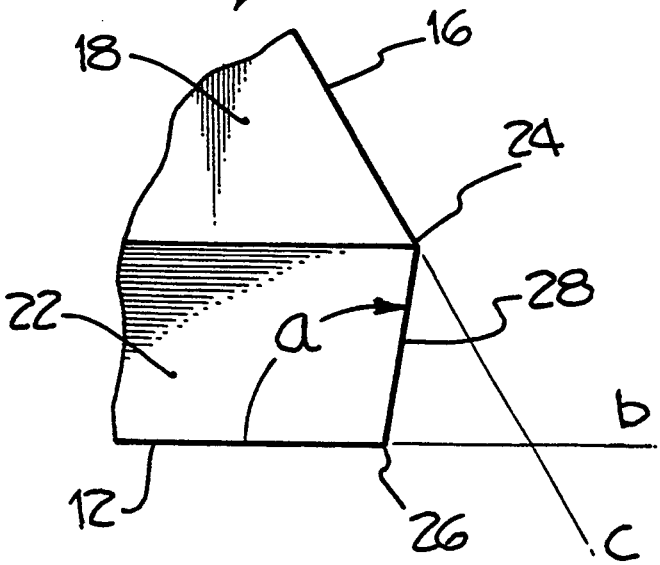
FIG. 2 is an enlarged front view of the safety blade showing the safety corner and cutting corner.
Figure 3:
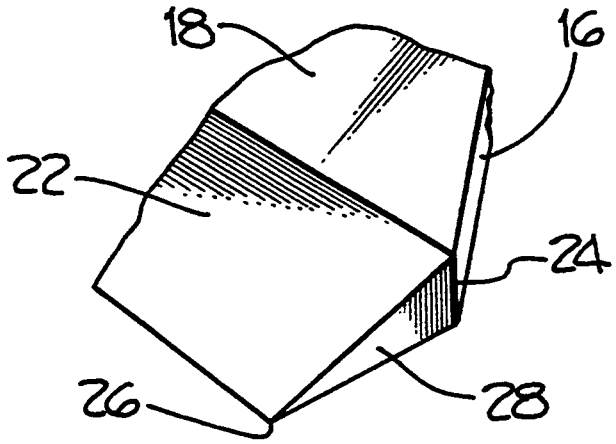
FIG. 3 is a perspective view of the safety corner of the safety blade.

Referring now to FIGS. 2 and 3, there is shown the safety edge of the present invention. In a typical blade, the side edge 16, denoted by line c, would intersect with the cutting edge 12, denoted by line b. At the intersection between lines b and c, a cutting corner would be formed. This cutting corner would be very sharp, since it lies at the narrowest point of the cutting edge 12. To form the safety edge of the present invention, a triangular portion of the blade 10 is removed. This safety edge 28 joins the side edge 16 at the start of the tapered portion 22, with the cutting edge 12. The angle formed between the safety edge 28 and the cutting edge 12 is denoted by a in FIG. 2. The angle a is obtuse, and in the preferred embodiment is approximately 100 degrees. At the intersection between the safety edge 28 and the side edge 16, a safety corner 24 is formed. Due to the thickness of the blade 10, the safety corner 24 is blunt and can be contacted with the skin of an operator without injury.

It is necessary that the angle formed between the safety edge 28 and the cutting edge 12 be greater than 90 degrees in order to insure that the safety corner 24 is disposed at the outermost distal end of the blade 10. This way, the safety corner 24 would contact an operator first, before any portion of the cutting edge 12. Nevertheless, a cutting corner 26 is formed between the intersection of the cutting edge 12 and the safety edge 28. This cutting corner 26 is still sharp enough to perform puncturing tasks as required by the operator.

To use the safety blade 10, a holder 30 is provided. The holder 30 can be formed from an impact resistant plastic or metal material, and would conform to the shape of an operator's hand. The blade 10 can be retracted so that it entirely fits within the handle, enabling the knife to be handled or stored. The blade can be extended outwardly relative the holder 30 so that the cutting edge 12 of the blade can be accessed. The typical blade 10 has an aperture pattern 34 which mates with an associated finger (not shown) formed within the holder 30. A retractor button 32 is typically provided which links to the blade and enables movement between the extended and retracted positions. When the extended portion of the cutting edge 12 of the blade 10 becomes dull, the blade can be flipped over and the other half of the blade used. The blade 10 can be removed from the holder and held with the operator contacting either the side edges 16, the safety edges 28, or the broad surfaces 18 of the blade.

Having thus described a preferred embodiment of a safety blade of a utility knife, it should now be apparent to those skilled in the art that the aforestated objects and advantages for the within invention have been achieved. It should also be appreciated by those skilled in the art that modifications, adaptations and alternative embodiments thereof may be made within the scope and spirit of the present invention. For example, alternative angles for the intersection between the safety edge and the cutting edge can be utilized to either increase the safety of the blade or improve the cutting ability of the cutting corner.

The present invention is further defined by the following claims:

What is claimed is:

1. A utility blade, comprising;

a blade body of a generally trapezoidal shape with a cutting edge and a pair of side edges, each of which is oriented at less than a right angle to said cutting edge, and which converge towards a blunt rear edge, wherein one of said side edges and at least a portion of said cutting edge is normally exposed during use; and a substantially planar safety edge joining each of said side edges with said cutting edge, each of said safety edges intersecting with said cutting edge and an adjacent side edge at obtuse angles and proving substantially blunt surfaces; and wherein a safety corner is thus provided at the intersection of each of said safety edges and its adjacent side edge which is laterally outward of the location on said blade where the associated safety edge intersects with said cutting edge.

2. A utility blade, comprising;

a cutting edge and a pair of side edges each of which is oriented at less than a right angle to said cutting edge, and which converge toward a blunt rear edge; and a substantially planar safety edge joining each of said edges with said cutting edge, each said safety edge intersecting with said cutting edge and an adjacent side edge at obtuse angles and providing a substantially blunt surface;

wherein one of said side edges and at least a portion of said cutting edge is normally exposed during usage and a safety corner is provided at the intersection of each safety edge and adjacent side edge, the safety corners thus provided being the laterally outermost portions of said blade.

3. A utility knife, comprising;

a safety blade having a cutting edge and a pair of side edges, each of which is oriented at less than a right angle to said cutting edge, and which converge toward a blunt rear edge, said blade having a uniform thickness and a tapered portion adjacent to said cutting edge which reaches a minimum thickness at said cutting edge, said blade further having a substantially planar safety edge joining each of said side edges with said cutting edge, each of said safety edges intersecting with said cutting edge and an adjacent side edge at obtuse angles and providing a substantially blunt surface; and a handle configured to receive said safety blade, wherein one of said side edges and at least a portion of said cutting edge are exposed during use and a safety corner is provided at the intersection of each of said safety edges and an adjacent side edge, the safety corners thus provided being the laterally outermost portions of said blade.

4. The utility knife of claim 3, further comprising;

an aperture pattern disposed in the central portion of said blade, said aperture pattern enabling engagement with said handle.

5. The utility knife of claim 3, further comprising cutting corners formed at intersections of said safety edges and said cutting edge, said cutting corners being disposed inwardly along said cutting edge relative said safety corners.

* * * * *